US009573382B1

(12) United States Patent
Metcalfe

(10) Patent No.: US 9,573,382 B1
(45) Date of Patent: Feb. 21, 2017

(54) SYSTEM AND METHOD FOR MISSING INKJET COMPENSATION IN A MULTI-LEVEL INKJET PRINTER

(71) Applicant: Xerox Corporation, Norwalk, CT (US)

(72) Inventor: David J. Metcalfe, Marion, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/058,972

(22) Filed: Mar. 2, 2016

(51) Int. Cl.
*B41J 2/21* (2006.01)

(52) U.S. Cl.
CPC ..... *B41J 2/2103* (2013.01)

(58) Field of Classification Search
CPC ..... B41J 2/2103
See application file for complete search history.

(56) References Cited

U.S. PATENT DOCUMENTS 5,635,967 A 6/1997 Klassen
6,215,557 B1 4/2001 Owens
6,575,549 B1 6/2003 Silverbrook
6,695,435 B1 2/2004 Cheng et al.
6,863,361 B2 3/2005 Barr et al.
6,880,907 B2 4/2005 Tsai
7,021,739 B2 4/2006 Burke et al.
7,075,677 B1 7/2006 Silverbrook
7,095,531 B2 8/2006 Mizes et al.
7,318,637 B2 1/2008 Ishimoto et al.
7,484,830 B2 2/2009 Kim et al.
7,639,402 B2 12/2009 Vestjens et al.
7,731,342 B2 6/2010 Mantell
7,815,274 B2 10/2010 De Waal
7,854,490 B2 12/2010 Snyder
7,866,778 B2 1/2011 Silverbrook et al.
7,903,290 B2 3/2011 Faken et al.
8,001,893 B2 8/2011 McCoy et al.
8,042,899 B2 10/2011 Folkins et al.
8,714,692 B1 5/2014 Metcalfe et al.
8,894,179 B1 11/2014 Metcalfe et al.
8,955,937 B2 2/2015 Metcalfe et al.
8,985,723 B2 3/2015 Metcalfe et al.
2004/0196320 A1 10/2004 Walmsley et al.
2005/0110817 A1 5/2005 Burke et al.
2005/0146543 A1 7/2005 Smith et al.
2005/0285897 A1 12/2005 Temple
2006/0082848 A1* 4/2006 Takakura ..... H04N 1/4015 358/534
2006/0125850 A1 6/2006 Kim et al.
2006/0279591 A1 12/2006 Lee
2006/0285131 A1 12/2006 Mantell et al.
2009/0231375 A1 9/2009 Folkins et al.
2009/0315939 A1 12/2009 Mantell et al.
2010/0245454 A1 9/2010 Ramakrishnan et al.

* cited by examiner

*Primary Examiner* — Stephen Meier
*Assistant Examiner* — Alexander D Shenderov
(74) *Attorney, Agent, or Firm* — Maginot Moore & Beck LLP

(57) ABSTRACT

A method of compensating for an inoperable inkjet in an inkjet printer that forms printed images with multiple drop sizes has been developed. The method includes identifying at least one neighboring pixel in a region of multi-bit halftoned image data around a pixel corresponding to the inoperable inkjet and modifying the at least one neighboring pixel to enable an inkjet that neighbors the inoperable inkjet to eject an ink drop during printing operation to compensate for the inoperable inkjet.

31 Claims, 10 Drawing Sheets

| ADOPTION SITES AVAILABLE | DROP SizeIn[1:0] | ADOPTION SITES INCREMENT | | | DROP SizeOut[1:0] |
|---|---|---|---|---|---|
| | | A[1:0] | B[1:0] | C[1:0] | |
| 0 | 1 | 0 | 0 | 0 | 1 |
| 0 | 2 | 0 | 0 | 0 | 2 |
| 0 | 3 | 0 | 0 | 0 | 3 |
| 1 | 1 | 1 | ... | ... | 0 |
| 1 | 2 | 2 | ... | ... | 1 |
| 1 | 3 | 3 | ... | ... | 2 |
| 2 | 1 | 1 | 0 | ... | 0 |
| 2 | 2 | 2 | 0 | ... | 0 |
| 2 | 3 | 3 | 0 | ... | 0 |
| 3 | 1 | 1 | 0 | 0 | 0 |
| 3 | 2 | 2 | 0 | 0 | 0 |
| 3 | 3 | 3 | 0 | 0 | 0 |

704

| ADOPTION SITES AVAILABLE | DROP SizeIn[1:0] | ADOPTION SITES INCREMENT | | | DROP SizeOut[1:0] |
|---|---|---|---|---|---|
| | | A[1:0] | B[1:0] | C[1:0] | |
| 0 | 1 | 0 | 0 | 0 | 1 |
| 0 | 2 | 0 | 0 | 0 | 2 |
| 0 | 3 | 0 | 0 | 0 | 3 |
| 1 | 1 | 1 | ... | ... | 0 |
| 1 | 2 | 2 | ... | ... | 1 |
| 1 | 3 | 3 | ... | ... | 2 |
| 2 | 1 | 1 | 0 | ... | 0 |
| 2 | 2 | 2 | 0 | ... | 0 |
| 2 | 3 | 3 | 0 | ... | 0 |
| 3 | 1 | 1 | 0 | 0 | 0 |
| 3 | 2 | 2 | 0 | 0 | 0 |
| 3 | 3 | 3 | 0 | 0 | 0 |

708

| ADOPTION SITES AVAILABLE | DROP SizeIn[1:0] | ADOPTION SITES INCREMENT | | | DROP SizeOut[1:0] |
|---|---|---|---|---|---|
| | | A[1:0] | B[1:0] | C[1:0] | |
| 0 | 1 | 0 | 0 | 0 | 1 |
| 0 | 2 | 0 | 0 | 0 | 2 |
| 0 | 3 | 0 | 0 | 0 | 3 |
| 1 | 1 | 1 | ... | ... | 0 |
| 1 | 2 | 2 | ... | ... | 1 |
| 1 | 3 | 3 | ... | ... | 2 |
| 2 | 1 | 1 | 0 | ... | 0 |
| 2 | 2 | 2 | 0 | ... | 0 |
| 2 | 3 | 3 | 0 | ... | 0 |
| 3 | 1 | 1 | 0 | 0 | 0 |
| 3 | 2 | 2 | 0 | 0 | 0 |
| 3 | 3 | 3 | 0 | 0 | 0 |

712

FIG. 7

| ADOPTION SITES AVAILABLE | DROP SizeIn[1:0] | ADOPTION SITES INCREMENT | | | DROP SizeOut[1:0] |
|---|---|---|---|---|---|
| | | A[1:0] | B[1:0] | C[1:0] | |
| 0 | 1 | 0 | 0 | 0 | 1 |
| 0 | 2 | 0 | 0 | 0 | 2 |
| 0 | 3 | 0 | 0 | 0 | 3 |
| 1 | 1 | 1 | ... | ... | 0 |
| 1 | 2 | 1 | ... | ... | 1 |
| 1 | 3 | 1 | ... | ... | 2 |
| 2 | 1 | 1 | 0 | ... | 0 |
| 2 | 2 | 1 | 1 | ... | 0 |
| 2 | 3 | 1 | 1 | ... | 1 |
| 3 | 1 | 1 | 0 | 0 | 0 |
| 3 | 2 | 1 | 1 | 0 | 0 |
| 3 | 3 | 1 | 1 | 1 | 0 |

868

| ADOPTION SITES AVAILABLE | DROP SizeIn[1:0] | ADOPTION SITES INCREMENT | | | DROP SizeOut[1:0] |
|---|---|---|---|---|---|
| | | A[1:0] | B[1:0] | C[1:0] | |
| 0 | 1 | 0 | 0 | 0 | 1 |
| 0 | 2 | 0 | 0 | 0 | 2 |
| 0 | 3 | 0 | 0 | 0 | 3 |
| 1 | 1 | 1 | ... | ... | 0 |
| 1 | 2 | 1 | ... | ... | 1 |
| 1 | 3 | 1 | ... | ... | 2 |
| 2 | 1 | 1 | 0 | ... | 0 |
| 2 | 2 | 1 | 1 | ... | 0 |
| 2 | 3 | 1 | 1 | ... | 1 |
| 3 | 1 | 1 | 0 | 0 | 0 |
| 3 | 2 | 1 | 1 | 0 | 0 |
| 3 | 3 | 1 | 1 | 1 | 0 |

872

| ADOPTION SITES AVAILABLE | DROP SizeIn[1:0] | ADOPTION SITES INCREMENT | | | DROP SizeOut[1:0] |
|---|---|---|---|---|---|
| | | A[1:0] | B[1:0] | C[1:0] | |
| 0 | 1 | 0 | 0 | 0 | 1 |
| 0 | 2 | 0 | 0 | 0 | 2 |
| 0 | 3 | 0 | 0 | 0 | 3 |
| 1 | 1 | 1 | ... | ... | 0 |
| 1 | 2 | 1 | ... | ... | 1 |
| 1 | 3 | 1 | ... | ... | 2 |
| 2 | 1 | 1 | 0 | ... | 0 |
| 2 | 2 | 1 | 1 | ... | 0 |
| 2 | 3 | 1 | 1 | ... | 1 |
| 3 | 1 | 1 | 0 | 0 | 0 |
| 3 | 2 | 1 | 1 | 0 | 0 |
| 3 | 3 | 1 | 1 | 1 | 0 |

876

FIG. 8
(CONTINUED)

SYSTEM AND METHOD FOR MISSING INKJET COMPENSATION IN A MULTI-LEVEL INKJET PRINTER

TECHNICAL FIELD

This disclosure relates generally to printers that eject ink from inkjets onto an image receiving surface and, more particularly, to printers that emit multiple ink drop sizes and that compensate for inoperable inkjets.

BACKGROUND

Drop on demand inkjet technology for producing printed media has been employed in commercial products such as printers, plotters, and facsimile machines. Generally, an inkjet image is formed by selectively ejecting ink drops from a plurality of inkjets, which are arranged in one or more printheads, onto an image receiving surface. In a direct inkjet printer, the printheads eject ink drops directly onto the surface of a print medium such as a paper sheet or a continuous paper web. In an indirect inkjet printer, the printheads eject ink drops onto the surface of an intermediate image receiving member such as a rotating imaging drum or belt. During printing, the printheads and the image receiving surface move relative to one other and the inkjets eject ink drops at appropriate times to form an ink image on the image receiving surface. A controller in the printer generates electrical signals, also known as firing signals, at predetermined times to activate individual inkjets in the printer. The ink ejected from the inkjets can be liquid ink, such as aqueous, solvent, oil based, UV curable ink or the like, which is stored in containers installed in the printer. Alternatively, some inkjet printers use phase change inks that are loaded in a solid form and delivered to a melting device. The melting device heats and melts the solid phase change ink to a liquid form that is supplied to a printhead for printing as liquid drops onto the image receiving surface.

During operation, some inkjets in one or more printheads fail to operate due to contaminants that clog nozzles or due to other malfunctions in the printhead. As used herein, the term "inoperable inkjet" refers to an inkjet that fails to eject ink drops onto the predetermined locations of an image receiving surface in a reliable manner during a printing operation. Inoperable inkjets may fail to eject ink drops entirely, eject drops only intermittently, or eject drops onto incorrect locations on the image receiving surface.

Existing compensation methods for inoperable inkjets identify pixel locations in binary halftoned image data that correspond to inoperable inkjets and redistribute the "orphan" pixels from the inoperable inkjet to neighboring inkjets to reduce the perceptible impact of the inoperable inkjet. However, the hardware and software implementations of prior art printers are not suited for use in printers that eject ink drops of different sizes from two or more arrays of inkjets in a print zone. As used herein, the term "multi-level" as used to apply to a printer or to image data for a printed image refers to configurations in which a combination of multiple drop sizes form printed images. For example, in a printer that forms images using two different drop sizes, each halftoned pixel has a total of four potential values or "levels" (e.g. no drops, one small drop, one large drop, or both a small and large drop) instead of the traditional binary image data that only includes two values for drop/no drop.

Consequently, improvements systems and methods for inoperable inkjet compensation methods in multi-level printers would be beneficial.

SUMMARY

In one embodiment, a method for printing pixels in an image to compensate for an inoperable inkjet in a multi-level printer has been developed. The method includes identifying, with a controller, a first pixel in multi-bit halftoned image data stored in a memory to be printed by an inoperable inkjet in a plurality of inkjets, identifying, with the controller, at least one neighboring pixel in a predetermined region of pixels around the first pixel to compensate for the first pixel with reference to a search of the predetermined region of pixels, generating, with the controller a modified multi-bit halftoned value for the at least one neighboring pixel to control operation of a neighboring inkjet of the inoperable inkjet to eject an ink drop based on the modified at least one neighboring pixel, and storing with the controller the at least one modified neighboring pixel in the memory to control operation of the plurality of inkjets to produce a printed image with the plurality of inkjets other than the inoperable inkjet to compensate for the inoperable inkjet.

In another embodiment, a multi-level inkjet printer that is configured to compensate for inoperable inkjets has been developed. The printer includes a plurality of inkjets and a controller operatively connected to the plurality of inkjets and a memory. The controller is configured to identify a first pixel in multi-bit halftoned image data stored in the memory to be printed by an inoperable inkjet in a plurality of inkjets, identify at least one neighboring pixel in a predetermined region of pixels around the first pixel to compensate for the first pixel with reference to a search of the predetermined region of pixels, generate a modified multi-bit halftoned value for the at least one neighboring pixel to control operation of a neighboring inkjet of the inoperable inkjet to eject an ink drop based on the modified at least one neighboring pixel, and store the at least one modified neighboring pixel in a memory to control operation of the plurality of inkjets to produce a printed image with the plurality of inkjets other than the inoperable inkjet to compensate for the inoperable inkjet.

BRIEF DESCRIPTION OF THE DRAWINGS

The foregoing aspects and other features of a printer that enable compensation for inoperable inkjets in an inkjet printer that forms printed images using multiple ink drop sizes are explained in the following description, taken in connection with the accompanying drawings.

FIG. 7 is a diagram of a lookup table that the printer uses to perform the compensation depicted in FIG. 6.

DETAILED DESCRIPTION

Figure 1:
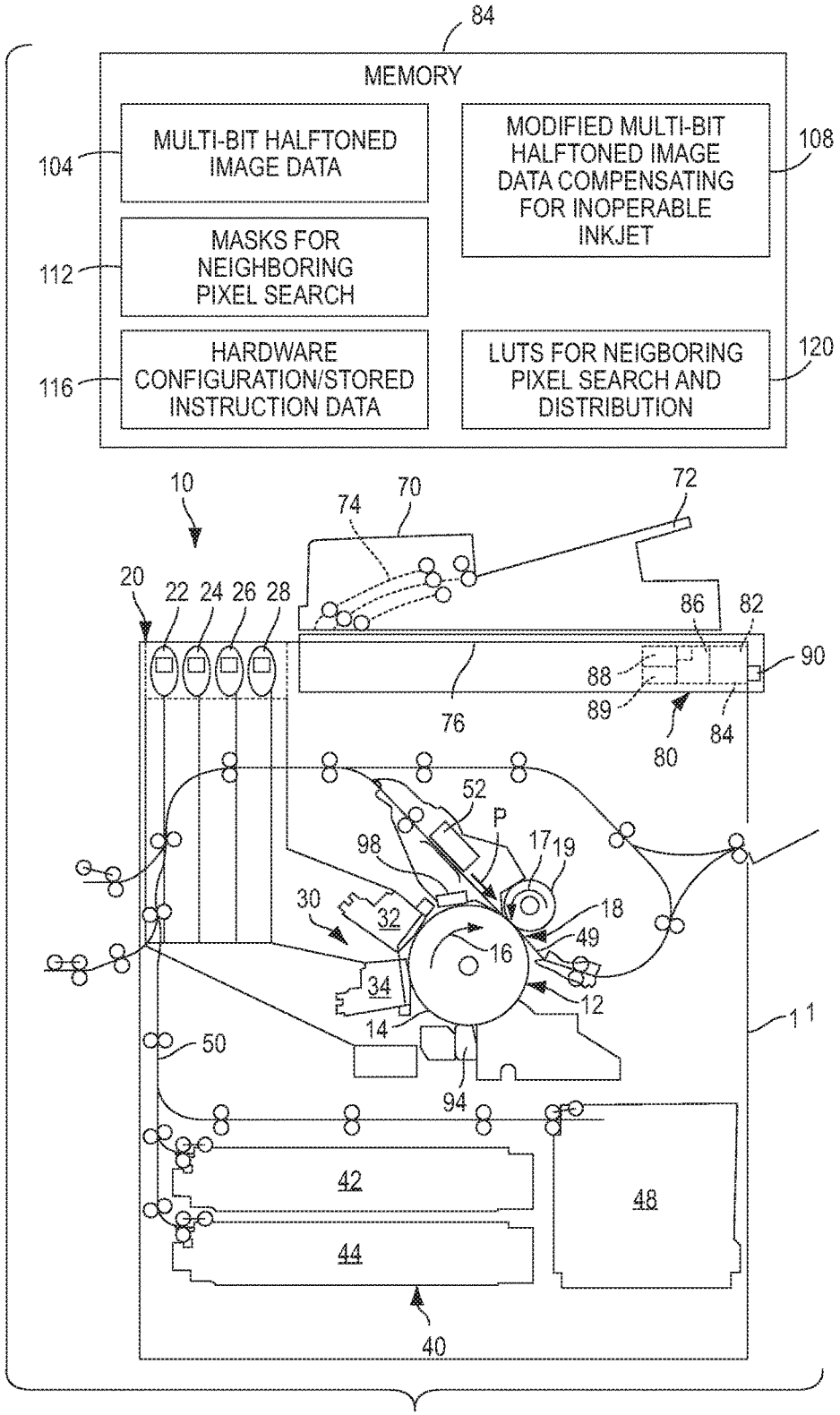
FIG. 1 is a schematic diagram of a multi-level inkjet printer that forms printed images with multiple sizes of ink drops and is configured to compensate for inoperable inkjets.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, etc.

As used herein, the term "inoperable inkjet" refers to a malfunctioning inkjet in a printer that does not eject ink drops, ejects ink drops only on an intermittent basis, or ejects ink drops onto an incorrect location of an image receiving member when the inkjet receives an electrical firing signal. A typical inkjet printer includes a plurality of inkjets in one or more printheads, and operational inkjets that are located near the inoperable inkjet can compensate for the inoperable inkjet to preserve the quality of printed images when an inkjet becomes inoperable.

As used herein, the term "pixel" refers to a single value in a two-dimensional arrangement of image data corresponding to an ink image that an inkjet printer forms on an image receiving surface. The locations of pixels in the image data correspond to locations of ink drops on the image receiving surface that form the ink image when multiple inkjets in the printer eject ink drops with reference to the image data. An "activated pixel" refers to a pixel in the image data that causes the printer to eject at least one drop of ink onto an image receiving surface location corresponding to the activated pixel. As described in more detail below, in a multi-bit printer embodiment, the printer is further configured to eject ink drops with varying sizes and combinations of different ink drops to deposit varying amounts of ink onto a single location in a printed image corresponding to each pixel. A "deactivated pixel" refers to a pixel in the image data having a value that does not cause the printer to eject a drop of ink onto an image receiving surface location corresponding to the deactivated pixel.

The term "multi-bit halftoned image data" refers to image data formed as a two-dimensional arrangement of pixels that are each encoded with more than two values that correspond to a plurality of different ink drop sizes that may be placed in each pixel location. A multi-level inkjet printer uses multi-bit halftoned image data to encode the different drop sizes that the printer uses to form printed images. For example, a two-bit multi-bit halftoned image data printer configuration provides four distinct levels of ink that can be ejected onto a single pixel including a deactivated pixel with no ink (e.g. 00), a "small" sized ink drop (e.g. 01), a "medium" sized ink drop (e.g. 10), and a "large" ink drop (e.g. 11). Of course, printers that operate using multi-bit halftoned image data may encode halftoned image data using additional bits that enable a larger number of levels (e.g. three bits for eight levels, four bits for sixteen levels, etc.). In many printers, the "medium" or "large" sized ink drops may be a composite drop that is formed by two or more ink drops having smaller sizes. As used herein, the term "composite ink drop" refers to an ink pattern formed on a location of an image receiving surface that corresponds to a single pixel, but that is actually formed by separate drops that are ejected from either a single inkjet that performs two or more ejection operations or from two or more different inkjets in a printer. Using the example above, in one embodiment of a printer, a first inkjet ejects "small" drops and a second inkjet that is aligned with the first inkjet in a cross-process direction ejects the "medium" sized drops, while a composite operation of both inkjets generates the "large" sized drop.

Halftoned image data are often arranged in a two-dimensional array with dimensions that correspond to the process direction and cross-process direction during a print job. As used herein, the term "pixel column" refers to an arrangement of pixels in image data that extend in the process direction P. Since the image receiving surface moves past the inkjets in a print zone in the process direction P, if an inkjet is inoperable, then the inkjet cannot eject the ink drops corresponding to activated pixels in a pixel column that is aligned with the inoperable inkjet in the print zone. As described below, the printer activates additional pixels in the image data for inkjets that are proximate to the inoperable inkjet in the cross-process direction to reduce or eliminate defects in the printed images that are formed with the inoperable inkjet.

As used herein, the term "process direction" (P) refers to a relative direction of motion between inkjets in a printhead and an image receiving surface, such as a print medium or an indirect image receiving member such as a rotating drum or belt. As described in more detail below, a single inoperable inkjet produces an artifact in a printed image corresponding to a linear streak arranged along the process direction corresponding to locations where the inoperable inkjet is unable to print ink drops. The term "cross-process direction" (CP) refers to an axis that extends across the image receiving surface perpendicular to the process direction. An array of inkjets includes neighboring inkjets that are located proximate to the inoperable inkjet along the cross-process direction axis. As described in more detail below, one or more neighboring inkjets eject additional ink drops to compensate for an inoperable inkjet in the printer.

As used herein, the term "image density" refers to a number of pixels in either image data or an ink image that receive ink drops. In a high density region, a comparatively large portion of the pixels are activated and the corresponding region of the image receiving surface receives a correspondingly large number of ink drops and, in a multi-bit halftoned printer, larger drop sizes. In a low density region, fewer pixels are activated and the corresponding region of the image receiving surface receives fewer ink drops.

FIG. 1 depicts an embodiment of a multi-level inkjet printer 10 that is configured to print images using multiple drop sizes based on multi-bit halftoned image data and to compensate for one or more inoperable inkjets. As illustrated, the printer 10 includes a frame 11 to which is mounted directly or indirectly all its operating subsystems and components, as described below. The phase change ink printer 10 includes an image receiving member 12 that is shown in the form of a rotatable imaging drum, but can equally be in the form of a supported endless belt. The imaging drum 12 has an image receiving surface 14, which provides a surface for formation of ink images. An actuator 94, such as a servo or electric motor, engages the image receiving member 12 and is configured to rotate the image receiving member in direction 16. A transfix roller 19 rotatable in the direction 17 loads against the surface 14 of drum 12 to form a transfix nip 18 within which ink images formed on the surface 14 are transfixed onto a heated print medium 49.

The phase change ink printer 10 also includes a phase change ink delivery subsystem 20 that has multiple sources of different color phase change inks in solid form. Since the phase change ink printer 10 is a multicolor printer, the ink delivery subsystem 20 includes four (4) sources 22, 24, 26, 28, representing four (4) different colors CMYK (cyan, magenta, yellow, and black) of phase change inks. The phase change ink delivery subsystem also includes a melting and control apparatus (not shown) for melting or phase changing the solid form of the phase change ink into a liquid form. Each of the ink sources 22, 24, 26, and 28 includes a reservoir used to supply the melted ink to the printhead assemblies 32 and 34.

In the example of FIG. 1, both of the printhead assemblies 32 and 34 receive the melted CMYK ink from the ink sources 22-28. In another embodiment, the printhead assemblies 32 and 34 are each configured to print a subset of the CMYK ink colors. In one system configuration, the printhead assemblies 32 and 34 eject ink drops with two different sizes, such as a smaller ink drop size from printhead assembly 32 and a larger size from the printhead assembly 34. Printer embodiments that incorporate multiple sets of inkjets to eject ink drops with different size are referred to as "two stack" or "multi stack" configurations. In another configuration, a printer includes a single printhead assembly with printheads that eject different sized ink drops from a single set of inkjets. In these "single stack" configurations, a single inkjet can eject different drop sizes in different operating modes. The printer moves the image receiving surface past the same inkjets for multiple passes to enable the inkjets to drops with multiple sizes onto the image receiving surface. In still another embodiment one or more printhead assemblies eject ink drops of only a single size but the printhead assemblies optionally eject multiple ink drops onto individual pixel locations to form composite drops with larger composite drop sizes. Any suitable printer embodiment that forms printed images with two or more effective drop sizes provides the physical ink drop characteristics for the printer to reproduce two-bit halftoned images with multiple drop sizes. Of course, while FIG. 1 is directed to a printer 10 that forms printed images using four halftoned levels in a two-bit configuration, the systems and methods presented herein are also suitable for use in multi-bit halftoned printer embodiments that produce a higher number of ink drop sizes and process multi-bit halftoned image data with an additional number of bits for each halftoned pixel (e.g. 3 bits, 4 bits, etc.).

The phase change ink printer 10 includes a substrate supply and handling subsystem 40. The substrate supply and handling subsystem 40, for example, includes sheet or substrate supply sources 42, 44, 48, of which supply source 48, for example, is a high capacity paper supply or feeder for storing and supplying image receiving substrates in the form of a cut sheet print medium 49. The phase change ink printer 10 as shown also includes an original document feeder 70 that has a document holding tray 72, document sheet feeding and retrieval devices 74, and a document exposure and scanning subsystem 76. A media transport path 50 extracts print media, such as individually cut media sheets, from the substrate supply and handling system 40 and moves the print media in a process direction P. The media transport path 50 passes the print medium 49 through a substrate heater or pre-heater assembly 52, which heats the print medium 49 prior to transfixing an ink image to the print medium 49 in the transfix nip 18.

Media sources 42, 44, 48 provide image receiving substrates that pass through media transport path 50 to arrive at transfix nip 18 formed between the image receiving member surface 14 and transfix roller 19 in timed registration with the ink image formed on the image receiving surface 14. As the ink image and media travel through the nip, the ink image is transferred from the surface 14 and fixedly fused to the print medium 49 within the transfix nip 18. In a duplexed configuration, the media transport path 50 passes the print medium 49 through the transfix nip 18 a second time for transfixing of a second ink image to a second side of the print medium 49.

Operation and control of the various subsystems, components and functions of the printer 10 are performed with the aid of a controller or electronic subsystem (ESS) 80. The ESS or controller 80, for example, is a self-contained, dedicated mini-computer having a central processor unit (CPU) 82 with a digital memory 84, and a display or user interface (UI) 86. The ESS or controller 80, for example, includes a sensor input and control circuit 88 as well as an ink drop placement and control circuit 89. In one embodiment, the ink drop placement control circuit 89 is implemented as a field programmable gate array (FPGA). In addition, the CPU 82 reads, captures, prepares and manages the image data flow associated with print jobs received from image input sources, such as the scanning system 76, or an online or a work station connection 90. As such, the ESS or controller 80 is the main multi-tasking processor for operating and controlling all of the other printer subsystems and functions.

The controller 80 can be implemented with general or specialized programmable processors that execute programmed instructions, for example, printhead operation. The instructions and data required to perform the programmed functions are stored in the memory 84 that is associated with the processors or controllers. The processors, their memories, and interface circuitry configure the printer 10 to form ink images, and, more particularly, to control the operation of inkjets in the printhead assemblies 32 and 34 to compensate for inoperable inkjets. These components are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components.

Figure 3:
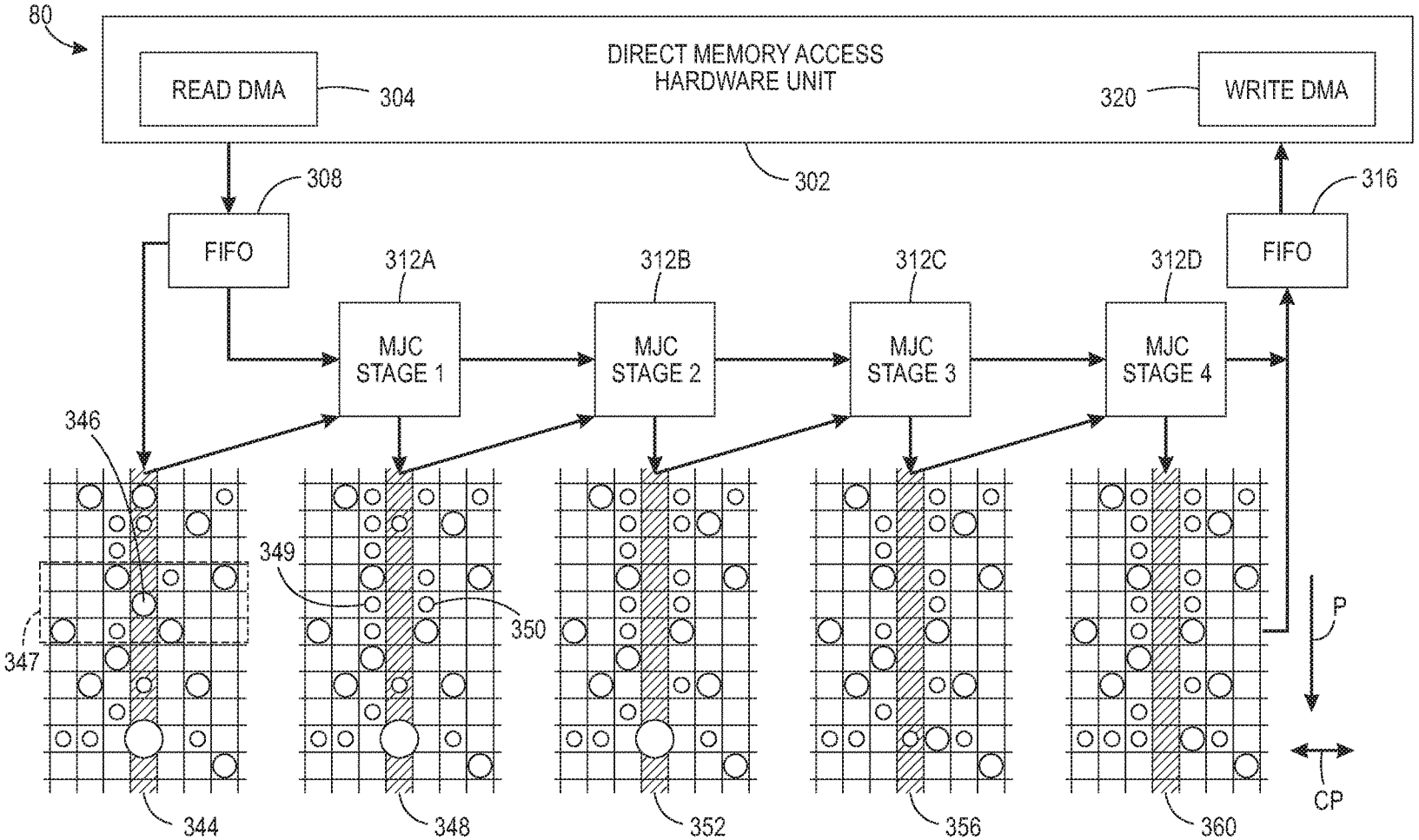
FIG. 3 is a schematic diagram of a configuration of hardware execution units in a field programmable gate array (FPGA) in a controller of the printer of FIG. 1.

In one embodiment, the controller 80 includes a reconfigurable digital processing device such as an FPGA that is reconfigurable based on a synthesized logic description, such as the hardware configuration data 116 that are stored in the memory 84. In a multi-bit halftoned printer, the controller 80 optionally includes a pipelined hardware configuration that is depicted in FIG. 3. In the pipelined configuration, a single direct memory access (DMA) hardware unit 302 reads the halftoned multi-bit image data from memory (read DMA 304) in a predetermined order to an input first-in first-out (FIFO) buffer 308. The input FIFO 308 provides the halftoned image data to a first missing jet compensation (MJC) module 312A in a pipeline of MJC modules 312A-312D. In the printer 10, the MJC modules 312A-312D are dynamically configured hardware modules that are implemented in an FPGA, although alternative embodiments implement the MJC units using fixed-function hardware modules or as multiple execution cores in a CPU. Each of the MJC modules 312A-312D processes a portion of the image data to modify the multi-bit halftoned image data pixels of neighboring inkjets around the inoperable inkjet to compensate for a portion of the pixels in a column of multi-bit halftoned image data that corresponds to an inoperable inkjet. FIG. 3 depicts a pipeline configuration of four MJC modules 312A-312D that each perform a portion of the compensation process in an exemplary two-bit image data printing system, although alternative embodiments use a pipeline configuration with a larger or smaller number of modules. The MJC module 312D at the end of the pipeline stores the final modified image data in an output FIFO buffer 316 and the DMA unit 302 writes the modified multi-bit halftoned image data to memory 84 with the write DMA unit 320. The controller 80 subsequently uses the modified multi-bit halftoned image data to control operation of the inkjets in the printhead assemblies 32 and 34 to form printed images that compensate for the inoperable inkjet and reduce or eliminate streaks and other perceptible artifacts in printed images.

As depicted above, the configuration of FIG. 3 includes a pipeline of four MJC modules 312A-312D that each perform a portion of the image data processing to compensate for a column of multi-bit image data that corresponds to an inoperable inkjet. FIG. 3 depicts a simplified set of sample input image data 344 that includes multiple pixels of image data that cannot be formed using the inoperable inkjet. In FIG. 3, the MJC module 312A receives the multi-bit halftoned image data 344 from the FIFO 308 and performs a portion of the compensation process that only redistributes pixels corresponding to "medium" sized droplets, such as the pixel 346. The first pipeline stage MJC module 312A generates output image data 348 where the input pixel 346 is redistributed to pixels 349 and 350. The output image data 348 becomes the input image data to the next MJC module 312B in the pipeline, which processes pixels corresponding to "small" ink drops. The MJC module 312B produces output image data 352, which are the input to the third MCJ stage 312C that processes pixels corresponding to the "large" composite drops and produces the output image data 356. Finally, the MJC module 312D receives the input image data 356 and produces the final output image data 360. The MJC module 312D compensates for any "residual" pixels in the column corresponding to the inoperable inkjet that none of the previous MJC modules 312A-312C processed due to, for example, a lack of available adoption sites. The final MJC module 312D writes the image data 360 to the output FIFO 316 and the write DMA unit 320 stores the modified multi-bit halftoned image data in the memory 84 for use in the printing process. The MJC modules 312A-312D are each configured with the same digital logic processing elements but perform different portions of the compensation process using different sections of reconfigurable lookup tables (LUTs) that are described in more detail below.

Each of the MJC modules 312A-312D includes a data buffer that stores a portion of the region of the image data around the inoperable inkjet, such as a seven pixel wide by three pixel long (7×3) set of image data or another suitable size for performing the compensation process. At any one time, each of the MJC modules 312A-312D in the pipeline only processes a comparatively small window of the multi-bit halftoned image data along the entire column of the image data, and the pipeline processes the entire column in progression using a "sliding window" technique to process successive rows of the image data. For example, the region 347 depicts the 7×3 pixel sliding window region around the pixel 346 in the image data 344. The data buffers within each MJC are quite small in comparison to the total size of the full image data stored in the external memory and accessed via the DMA unit 302, and these memory buffers can be implemented as memory registers or other suitable logic structures in an FPGA or other digital logic device in a practical manner. Thus, only the first MJC module 312A needs to access the external memory to receive input image data and only the final MJC module 312D needs to write fully processed output image data to the external memory. After each MJC module completes processing of the image data within the buffer, the module passes the buffer to the next MJC module in the pipeline for additional processing as described above.

The pipeline depicted in FIG. 3 processes the multi-bit halftoned image data corresponding to a single inoperable inkjet and optionally processes multiple sets of the multi-bit halftoned image data for more multiple inoperable inkjets in a predetermined order. While FIG. 3 depicts a single pipeline for illustrative purposes, alternative embodiments optionally include multiple pipelines that can process the image data corresponding to multiple inoperable inkjets in parallel as long as the inoperable inkjets are separated from each other by a sufficient distance in the cross-process direction to avoid overlapping neighboring pixel regions (e.g. separated by at least 6 pixels in the example of FIG. 3).

Referring again to FIG. 1, the memory 84 includes one or more non-volatile data storage devices, such as solid state, magnetic, or optical data storage devices, in addition to volatile memory such as random access memory (RAM). As depicted in FIG. 1, the memory 84 stores multi-bit halftoned image data 104, modified multi-bit halftoned image data that compensates for inoperable inkjets in the printer 108, masks for searching neighboring pixels around an inoperable inkjet 112, hardware configuration data and stored program instruction data 116, and LUTs for neighboring pixel search and distribution to compensate for pixels that correspond to an inoperable inkjet 120. The multi-bit halftoned image data 104 includes a two-dimensional array of pixels corresponding to one or more images that the printer 10 forms during a printing operation. The controller 80 in the printer 10 or an external control device performs a halftoning process that is known to the art to convert a continuous tone (contone) image into a device-specific color space for the printer 10 and generates multi-bit halftoned image data that directly corresponds to the physical arrangement of drops and drop sizes in a final printed image. The modified multi-bit halftoned image data 108 includes additional modifications that the printer 10 performs to the multi-bit halftoned image data 104 to compensate for one or more inoperable inkjets in the printhead assemblies 32 and 34.

While FIG. 1 depicts the multi-bit halftoned image data 104 separately from the modified multi-bit halftoned image data 108 for illustrative purposes, in some embodiments the controller 80 overwrites the original multi-bit halftoned image data 104 with the modified multi-bit halftoned data 108. The controller 80 uses the masks 112 to omit one or more pixels in a region that neighbors a pixel from an inoperable inkjet during a search process to identify neighboring pixels as adoption sites for a corresponding to the inoperable inkjet. The hardware configuration data 116 includes synthesized place and route configuration data for an FPGA or other reconfigurable logic device in addition to stored program instructions that a microprocessor executes during operation of the printer 10. The LUTs 120 include configuration data that the controller 80 uses to control the operation of the search process and to control the modification process of the multi-bit halftoned image data in neighboring pixels around a pixel column corresponding to the inoperable inkjet to compensate for the inoperable inkjet. The memory 84 stores multiple versions of the LUTs 120 or provides an interface to enable reconfiguration of the LUTs 120 to enable the printer 10 to perform multiple compensation processes for inoperable inkjets without requiring additional modifications to hardware or software.

During operation, the printer 10 ejects a plurality of ink drops from inkjets in the printhead assemblies 32 and 34 onto the surface 14 of the image receiving member 12. The controller 80 generates electrical firing signals to operate individual inkjets in one or both of the printhead assemblies 32 and 34. In the multi-color printer 10, the controller 80 processes digital image data corresponding to one or more printed pages in a print job, and the controller 80 generates multi-bit halftoned image data for each of the CMYK color separations. Each bit map includes a two dimensional arrangement of pixels corresponding to locations on the image receiving member 12. Each pixel has three or more potential values that indicate if the pixel is activated, and which size of ink drop or combination of ink drops should be printed, or deactivated in which case the pixel receives no ink drops. The controller 80 generates a firing signal to activate an inkjet and eject a drop of ink onto the image receiving member 12 for the activated pixels, but does not generate a firing signal for the deactivated pixels. The combined bit maps for each of the colors of ink in the printer 10 generate multicolor or monochrome images that are subsequently transfixed to the print medium 49. The controller 80 generates the bit maps with selected activated pixel locations to enable the printer 10 to produce multicolor images, half-toned images, dithered images, and the like.

During a printing operation, one or more of the inkjets in the printhead assemblies 32 and 34 may become inoperable. An inoperable inkjet may eject ink drops on an intermittent basis, eject ink drops onto an incorrect location on the image receiving surface 14, or entirely fail to eject ink drops. In the printer 10, an optical sensor 98 generates image data corresponding to the ink drops that are printed on the image receiving surface 14 after formation of the ink images and prior to the imaging drum 12 rotating through the nip 18 to transfix the ink images. In one embodiment, the optical sensor 98 includes a linear array of individual optical detectors that detect light reflected from the image receiving surface. The individual optical detectors each detect an area of the image receiving member corresponding to one pixel on the surface of the image receiving member in a cross-process direction, which is perpendicular to the process direction P. The optical sensor 98 generates digital data, referred to as reflectance data, corresponding to the light reflected from the image receiving surface. The controller 80 is configured to identify inoperable inkjets in the printhead assemblies 32 and 34 with reference to the reflectance values detected on the imaging receiving surface 14 and the predetermined image data of the printed ink images. In an alternative embodiment, an optical sensor detects defects in ink images after the ink images have been formed on the print medium 49. In another alternative embodiment, the inoperable inkjets are identified with sensors located in the printhead assemblies. In response to identifying an inoperable inkjet, the controller 80 ceases generation of firing signals for the inoperable inkjet, and generates firing signals for other inkjets that are proximate the inoperable inkjet in the printer to compensate for the inoperable inkjet.

The printer 10 is an illustrative embodiment of a printer that compensates for inoperable inkjets using the processes described herein, but the processes described herein can compensate for inoperable inkjets in alternative inkjet printer configurations. For example, while the printer 10 depicted in FIG. 1 is configured to eject drops of a phase change ink, alternative printer configurations that form ink images using different ink types including aqueous ink, solvent based ink, UV curable ink, and the like can be operated using the processes described herein. Additionally, while printer 10 is an indirect printer, the processes described herein are also suitable for use with direct printers that eject ink drops directly onto a print medium.

Figure 2:
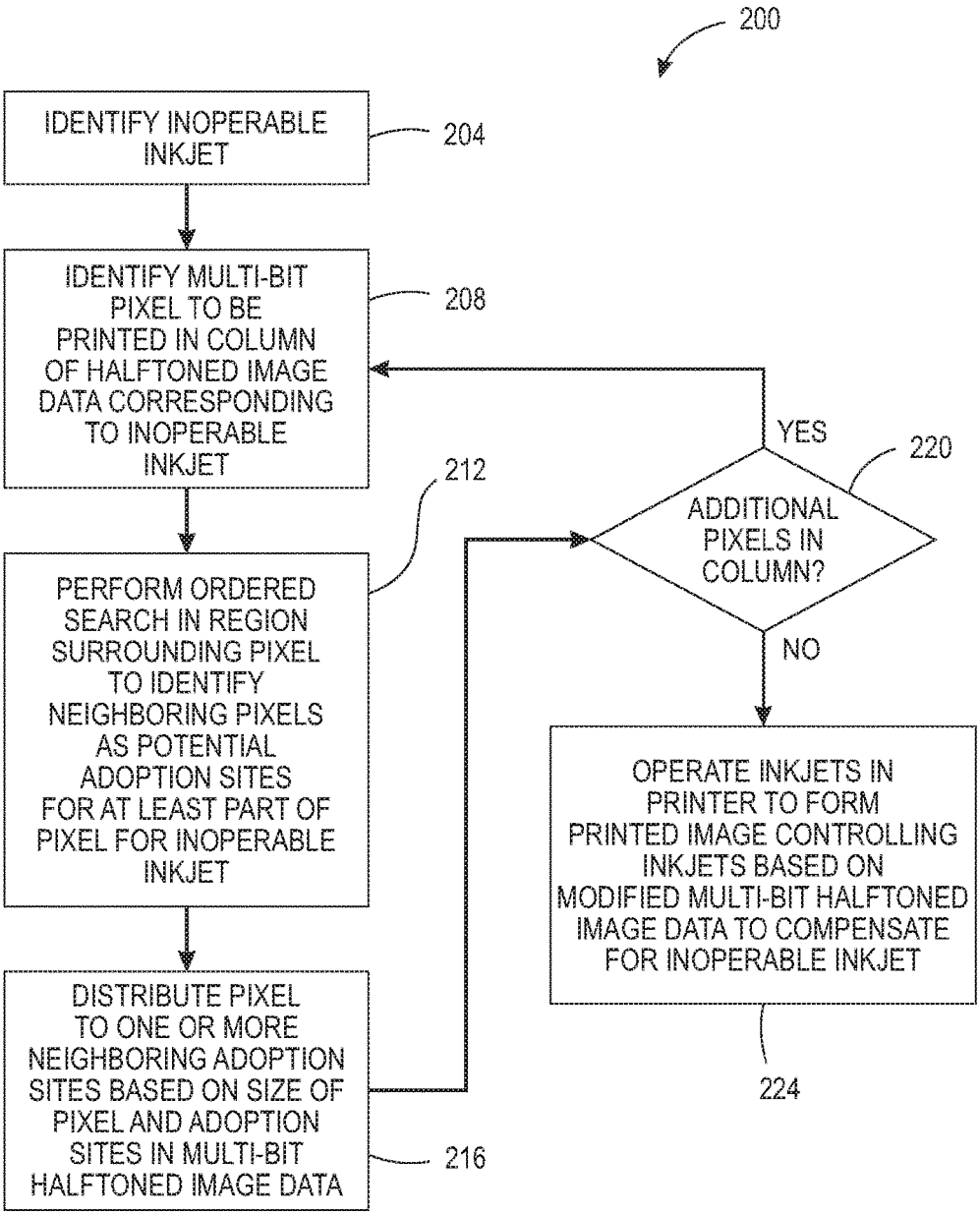
FIG. 2 is a block diagram of a process for modifying multi-bit halftoned image data to compensate for an inoperable inkjet in a multi-level inkjet printer.

FIG. 2 depicts a process 200 for modifying multi-bit halftoned image data to reduce or eliminate the perceptibility of an inoperable inkjet in printed images. In the description below, a reference to the process 200 performing or doing some function or action refers to one or more controllers or processors that are configured with programmed instructions to implement the process performing the function or action or operating one or more components to perform the function or action. Process 200 is described with reference to the printer 10 of FIG. 1 for illustrative purposes.

Process 200 begins as the controller 80 identifies an inoperable inkjet in the printer (block 204). In the printer 10, the optical sensor 98 generates scanned image data of printed ink test patterns on the surface 14 of the imaging drum 12. The controller 80 analyzes the scanned image data to identify one or more inkjets in the printhead assemblies 32 and 34 that are inoperable. Existing techniques for the identification of inoperable inkjets are known to the art and are not presented in further detail herein.

Figure 4:
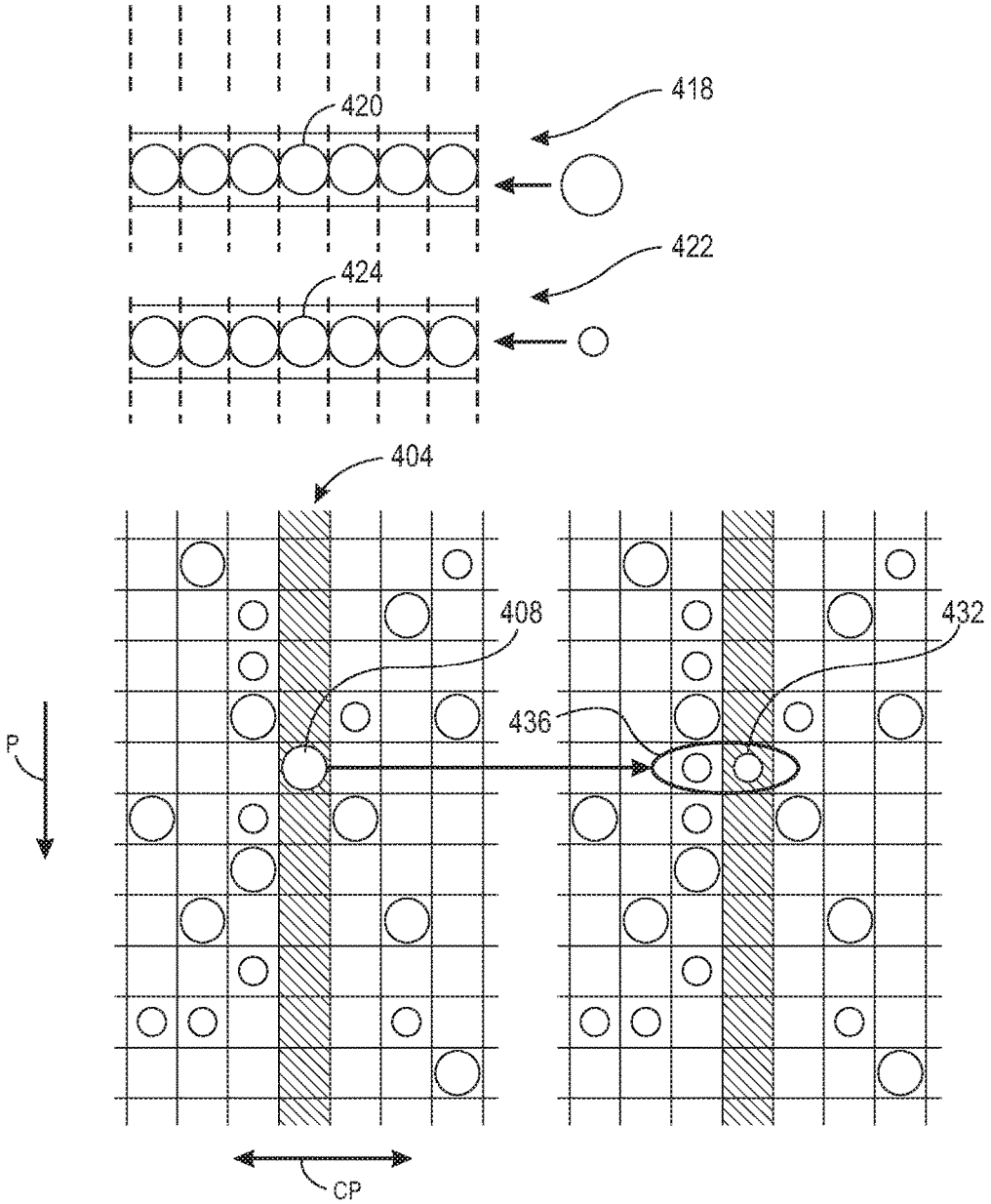
FIG. 4 is a diagram depicting compensation for an inoperable inkjet in an inkjet printer with two arrays of inkjets that are aligned with each other in a cross-process direction.

After identification of an inoperable inkjet, the printer 10 identifies an activated pixel in a column of the halftoned multi-bit image data that corresponds to the inoperable inkjet (block 208). Since the halftoned image data are arranged in a two-dimensional array that corresponds to the predetermined physical arrangement of inkjets, the controller 10 identifies the column of image data that extends in the process direction corresponding to the inoperable inkjet via a LUT or other similar operation. For example, in FIG. 4 the column 404 corresponds to the location in the cross-process direction CP of an inoperable inkjet 420. In FIG. 4, the pixel 408 corresponds to a medium-sized ink drop that is emitted from the inkjet 420 when the inkjet 420 is operable. In one configuration, the controller 80 processes the pixels in the column corresponding to the inoperable inkjet in a predetermined order to identify activated pixels with varying halftoned levels (e.g. small ink drop, medium ink drop, or a large ink drop formed from a small and medium drop).

Figure 5:
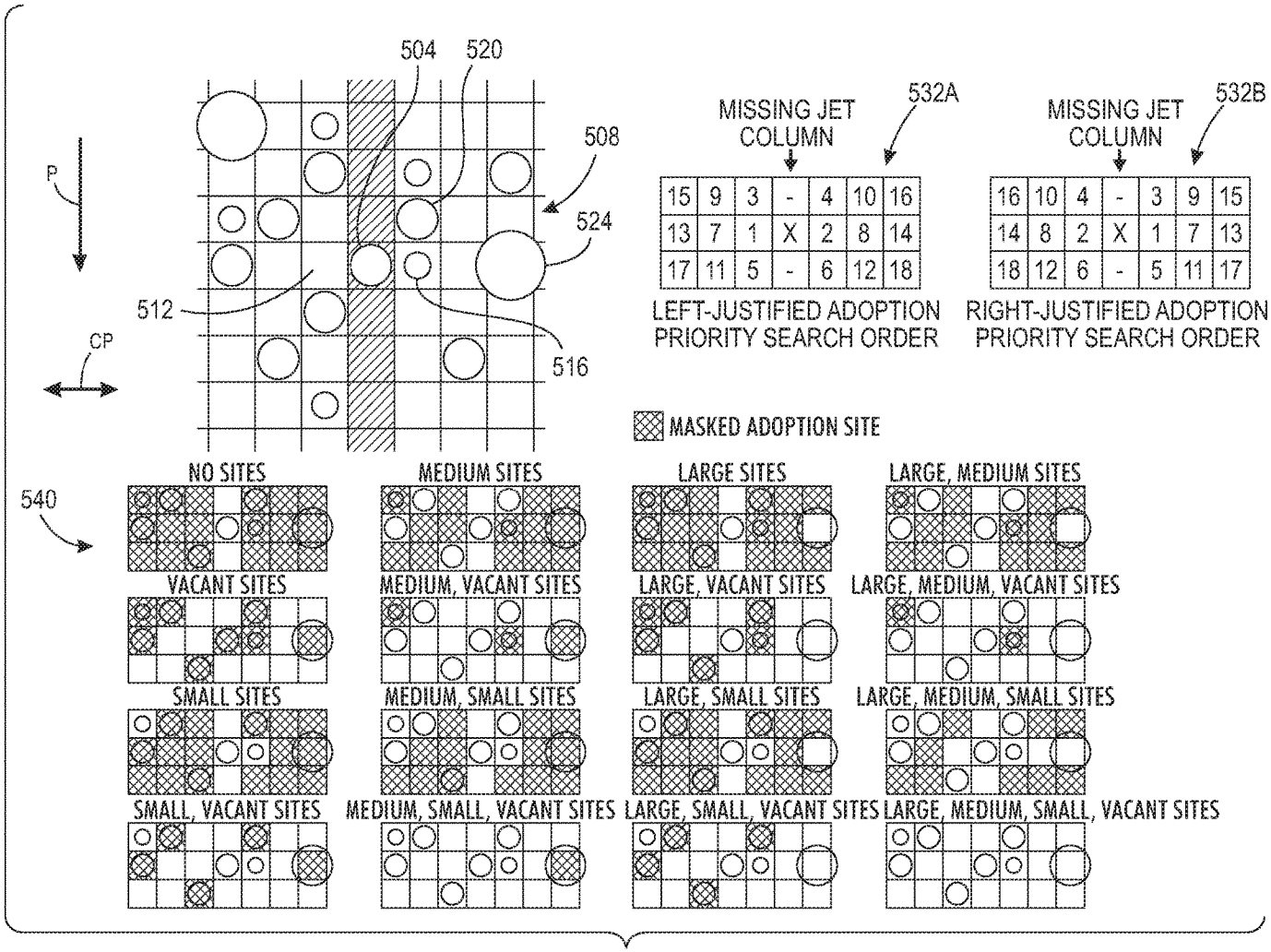
FIG. 5 is a diagram depicting a region of pixels that neighbor a pixel corresponding to an inoperable inkjet in a printer and illustrative examples of predetermined search orders and search masks that the printer uses to identify one or more neighboring pixels as adoption sites for the pixel of the inoperable inkjet.

Process 200 continues as the controller 80 performs an ordered search process in a predetermined region of pixels that surround the identified pixel to identify at least one neighboring pixel that serves as an "adoption site" for a first pixel that corresponds to the inoperable inkjet (block 212). FIG. 5 depicts a first pixel 504 that corresponds to an inoperable inkjet and a region of pixels 508 that correspond to neighboring inkjets around the inoperable inkjet. In the illustrative example of FIG. 5, the region 508 includes a total of 18 pixels arranged in a 3 row by 3 column grid on either side of the inoperable inkjet in the cross-process direction CP, although alternative embodiments use regions with different sizes and shapes. The neighboring pixels that are positioned in the same column of multi-bit halftoned image data as the first identified pixel 504 are not included in the region since the inoperable inkjet cannot print to those locations either. In many instances the region includes a set of pixels that are activated with various multi-bit values such as a small ink drop pixel 516, medium ink drop pixel 520, and large ink drop pixel 524. Other pixels in the region 508 are deactivated, such as the pixel 512.

The controller 80 searches for deactivated pixels in the region 508 based on a predetermined search order. In FIG. 5, the tables 532A and 532B depict two different search orders in which the controller 80 identifies potentially deactivated pixels beginning with the lower-numbered pixels in each table until the controller 80 has identified a sufficient number of deactivated pixels to continue with distribution of the pixel from the inoperable inkjet to the identified neighboring pixels. The predetermined search order tables 532A and 532B are mirrored about the process direction axis P. In some embodiments, the controller 80 uses one of the search tables 532A and 532B for one pixel in the column corresponding to the inoperable inkjet and alternates to use the other search table for the next pixel in the column to maintain an even distribution of adoption sites across both the right and left sides of the column of pixels corresponding to the inoperable inkjet.

In some embodiments, the controller 80 does not perform the search using every potential neighbor pixel in the region of pixels that surrounds the inoperable inkjet. Instead, the controller 80 applies a predetermined bit mask to the region and omits any pixels that correspond to a mask 112 during the search. The masks include selected pixels that are not included in the search based on various factors including specific characteristics of different printer models, and in some instances pixels are masked if the pixels are reserved for compensation of other nearby pixels in the column of image data corresponding to the inoperable inkjet. Other mask types are based on the different sizes of ink drops in activated pixels in the predetermined region. FIG. 5 depicts examples of different types of mask 540 that the controller 80 can apply to the image data, although the examples in FIG. 5 are not exhaustive of all suitable mask patterns. During the search operation, the controller 80 only searches pixels in the predetermined region that are not included in the mask to identify neighboring pixels that can receive all or a portion of the ink from the pixel corresponding to the inoperable inkjet. The controller 80 still performs the search of the unmasked pixels in the predetermined search order that is described above.

In some embodiments, the search process continues until the controller 80 either identifies a predetermined number of suitable neighboring pixels that can receive all or a part of the ink for the first pixel of the inoperable inkjet or the controller 80 searches all of the available neighboring pixels without identifying one or more suitable neighboring pixels. For example, in the printer 10 that employs a two-bit halftoned process, the controller 80 identifies up to three neighboring pixel locations that can serve as adoption sites for a large ink drop that is distributed to a single neighboring pixel (large ink drop moved to a single neighboring pixel), two neighboring pixels (one small ink drop and one medium ink drop), or three neighboring pixels (three small ink drops). Other configurations of the printer 10 search for a different number of pixel locations. In some high density regions of a printed image, the search process may fail to identify one or more deactivated neighboring pixels in the region that may serve as adoption sites. As described in more detail below in FIG. 9, the controller 80 optionally identifies neighboring pixels that already include an ink drop that is less than the maximum size for the printer (e.g. a small or medium sized drop in the example of the printer 10), and modifies the multi-bit values of the neighboring pixels to increase the sizes of ink drops in those pixels to serve as the adoption sites.

Process 200 continues as the controller 80 generates modified multi-bit halftoned image data in the identified neighboring pixels in the region around the first pixel of the inoperable inkjet (block 216). During process 200, the controller 80 stores the modified multi-bit halftoned image data in the memory 84 to control the operation of the inkjets in the printhead assemblies 32 and 34 during a printing operation. FIG. 4 and FIG. 6-FIG. 9 depict various processes for modifying the values of the identified pixels in the region surrounding the pixel of the inoperable inkjet to distribute the ink from the inoperable inkjet to neighboring inkjets to compensate for the inoperable inkjet.

FIG. 4 depicts a distribution process in a printer that includes a "two stack" configuration with multiple sets of inkjets that are aligned with each other in the cross-process direction. For example, in FIG. 4 the inkjets 418 are arranged a printhead that ejects medium sized ink drops while the inkjets 422 are arranged in a printhead that ejects smaller sized ink drops. In FIG. 4, the inkjet 420 is inoperable, and the pixel column 404 includes a first pixel of multi-bit halftoned image data corresponding to a medium sized ink drop that the inkjet 420 cannot eject during the printing operation. However, in FIG. 4 the inkjet 424 remains operable. The controller 80 uses the small drop inkjet 424 to form the drop 432 and the controller 80 further modifies the value of the neighboring multi-bit pixel 436 to eject another small drop. The two small drops compensate for the missing drop from the inoperable inkjet 420.

Figure 6:
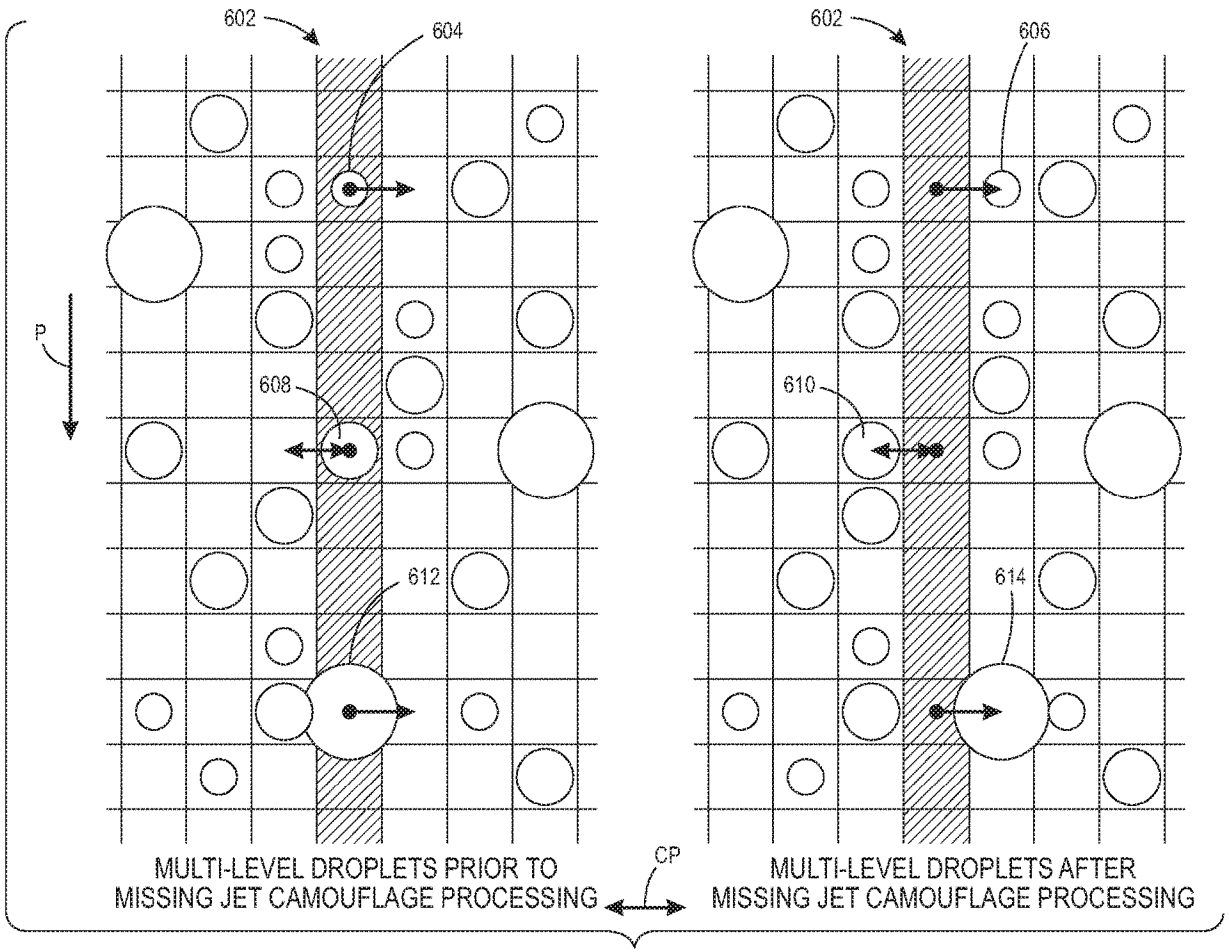
FIG. 6 is a diagram depicting compensation for an inoperable inkjet in an inkjet printer in which the printer modifies a single neighboring pixel in a region surrounding a pixel corresponding to the inoperable inkjet to compensate for the pixel from the inoperable inkjet.

While FIG. 4 depicts a printer configuration with redundant inkjets that can at least partially compensate for an inoperable inkjet within the same column of halftoned image data, other configurations distribute the ink from a pixel of an inoperable inkjet only to one or more of the neighboring pixels that are identified during the search process. FIG. 6 depicts a column of multi-bit halftoned image data 602 corresponding to an inoperable inkjet with three different pixels 604, 608, and 612 having values corresponding to small, medium, and large ink drops, respectively. In FIG. 6, the controller 80 identifies a single neighboring pixel in the region around each of the pixels of the inoperable inkjet as an adoption site. For example, the controller 80 modifies the pixel 606 with a multi-bit halftoned image data value corresponding to a small ink drop to compensate for the pixel 604 of the inoperable inkjet. Similarly, the controller 80 modifies the pixels 610 and 614 with multi-bit values corresponding to medium and large drop sizes, respectively, to compensate for the pixels 608 and 612, respectively.

FIG. 7 depicts lookup tables that one embodiment of the controller 80 uses to control distribution of the pixels from the inoperable inkjet to neighboring inkjets in the graph of FIG. 6. The lookup tables depicted in FIG. 7 are identical, but illustrate a selected set of parameters for each of the corresponding pixels 604, 608, and 612 from FIG. 6. For example, the table 704 corresponds to a configuration where the controller 80 has identified three neighboring pixels that are potential adoption sites (with three being a predetermined maximum number that may be reconfigured for different printer embodiments). Further, the table 704 indicates the identified input drop size as "1", which indicates small ink drop size, and an adoption site increment of "1" corresponding to the small ink drop. The three columns A-C indicate the three identified neighboring pixels that the controller 80 may modify to compensate for the pixel from the missing inkjet, although in the example of FIG. 6 the controller only modifies a single neighboring pixel that is identifies with the highest priority during the search process. The "drop size out" column has a value of "0" whenever the printer 10 completely compensates for a pixel from the inoperable inkjet, although as depicted in the top three rows of each table, when the controller 80 cannot find any adoption sites in the region around the first pixel of the inoperable inkjet, the drop out size corresponds to the drop in size. Tables 708 and 712 include similar characteristics corresponding to the pixel 608 and pixel 612, respectively, in FIG. 6. The tables 704-712 are illustrative examples of lookup tables (LUTs) that the controller 80 uses to control the distribution process to modify neighboring pixels around a pixel from the inoperable inkjet during the process 200. As depicted below, a modification to the LUT adjusts the process that the controller 80 performs to modify the multi-bit values of one or more neighboring pixels without requiring changes to the hardware configuration of the controller 80.

Figure 8:
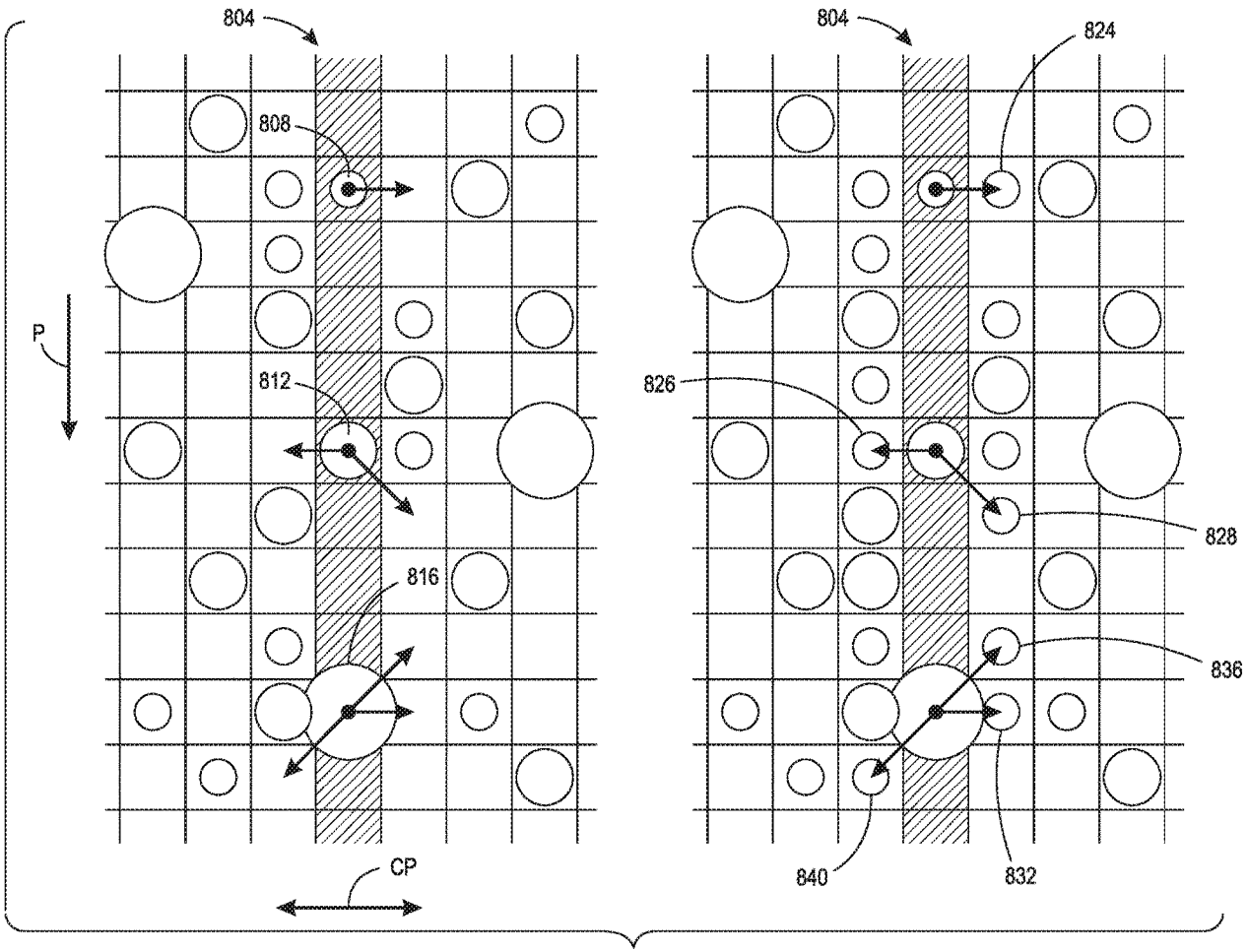
FIG. 8 is a diagram depicting compensation and corresponding lookup tables for an inoperable inkjet in an inkjet printer in which the printer modifies one or more neighboring pixels in a region surrounding pixels corresponding to the inoperable inkjet to compensate for the pixels from the inoperable inkjet.

FIG. 8 depicts another configuration of the process for modification of the values of neighboring multi-bit pixels during process 200. In FIG. 8, the pixel column 804 corresponds to an inoperable inkjet and pixels 808, 812, and 816 include multi-bit halftoned values corresponding to a small, medium, and large sized ink drop, respectively. In FIG. 8, the controller 80 only compensates for each of the pixels 808-816 using small sized ink drops in varying numbers of neighboring pixels. For example, the controller 80 modifies a single neighboring pixel 824 to compensate for the pixel 808. For the medium sized pixel 812, the controller 80 modifies two neighboring pixels 826 and 828. For the large sized pixel 816, the controller modifies three neighboring pixels 832, 836, and 840. FIG. 8 also depicts lookup tables 868, 872, and 876 with the selected entries that the controller 80 uses to control the modifications to the neighboring pixels in the multi-bit halftoned image data for each of the pixels, 808, 812, and 816, respectively. The tables of FIG. 8 include the small ink drop size value ("1") for a single neighboring pixel (table 868), two neighboring pixels (table 872), or three neighboring pixels (table 876), depending upon the multi-bit halftoned value of the pixel corresponding to the inoperable inkjet.

Figure 9:
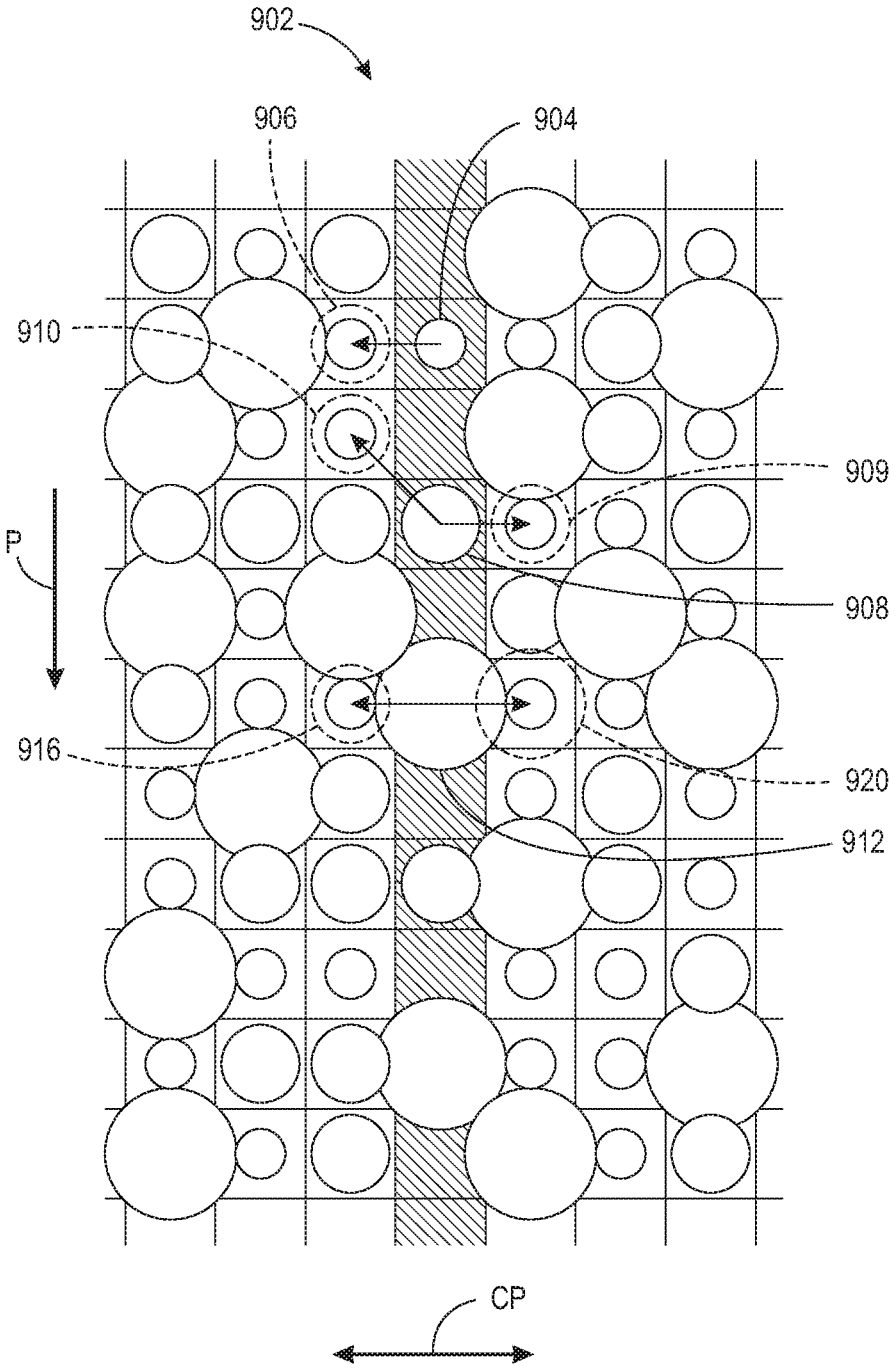
FIG. 9 is a diagram depicting compensation for an inoperable inkjet in a high density region of a printed image in which the printer modifies neighboring pixels of multi-bit halftoned image data to increase the sizes of ink drops that the neighboring inkjets print to compensate for the pixels from the inoperable inkjet.

FIG. 9 depicts a pixel replacement configuration in a region of high density image data in which the controller 80 does not identify deactivated pixels to serve as adoption sites during the search process. In FIG. 9, the pixel column 902 corresponds to an inoperable inkjet and includes various activated pixels including pixels 904, 908, and 912 that include multi-bit halftoned values correspond to small, medium, and large ink drops, respectively. In FIG. 9, no deactivated neighboring pixels are available for the controller 80 to act as adoption sites for pixels in the column 902. Instead, the controller 80 identifies one or more activated neighboring pixels that have multi-bit halftoned image values corresponding to ink drop sizes that are less than the maximum size for the printer (e.g. small or medium sized drops for the printer 10). The controller 80 modifies the values of the multi-bit halftoned data in the identified neighboring pixels to increase the size of ink drops in the neighboring pixels to compensate for the pixels of the inoperable inkjet. For example, in FIG. 9 the controller 80 modifies the value of the pixel 906 to increase the size of the corresponding ink drop from a small drop to a medium sized drop to compensate for the pixel 904. The controller 80 similarly modifies the values of the pixels 909 and 910 to increase the size of two small ink drops to medium sized ink drops to compensate for the pixel 908. The controller 80 modifies the pixels 916 and 920 to increase the ink drop sizes from small to medium and from medium to large, respectively, to compensate for the pixel 912.

Process 200 continues as described above with reference to the processing of blocks 208-216 for any additional pixels in the column of multi-bit halftoned image data corresponding to the inoperable inkjet (block 220). Once the controller has modified all of the pixels in the column of image data corresponding to the inoperable inkjet and stored the modified multi-bit halftoned image data in the memory 84, the controller 80 performs a printing operation using the multi-bit halftoned image data including the modified neighboring pixels to form a printed pattern of ink drops on an image receiving surface (block 224). In the printer 10, the controller 80 uses the modified multi-bit halftoned image data to generate electrical firing signals for the operable inkjets in the printhead assemblies 32 and 34, and the printer 10 transfixes the ink image from the image receiving drum 12 to a print medium to produce the printed image. The operable inkjets eject ink drops of the predetermined sizes for the printer 10 to form a printed image that corresponds to the modified multi-bit halftoned image data. The controller 80 deactivates any identified inoperable inkjets to ensure that the printed image is formed using only the operable inkjets in the printhead assemblies 32 and 34. The controller 80 operates the neighboring inkjets of the inoperable inkjet to eject the additional ink drops based on the modified multi-bit halftoned image data to compensate for the inoperable inkjet and reduce or eliminate streaks or other artifacts that would otherwise be caused by the inoperable inkjet in the printed image.

While process 200 is described for processing of individual pixels that correspond to an inoperable inkjet, in some embodiments the controller 80 performs parallel processing of the multi-bit halftoned image data to generate the modified multi-bit halftoned image data for multiple pixels concurrently. Additionally, the printer 10 optionally performs the process 200 for multiple inoperable inkjets in situations where more than one inkjet in the printhead assemblies 32 and 34 fails to operate properly.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for printing pixels in an image comprising:

identifying, with a controller, a first pixel in multi-bit halftoned image data stored in a memory to be printed by an inoperable inkjet in a plurality of inkjets;

identifying, with the controller, a plurality of neighboring pixels in a predetermined region around the identified first pixel, the pixels in the identified plurality of pixels having multi-bit values corresponding to deactivated pixels;

identifying, with the controller, at least one neighboring pixel in the predetermined region of pixels around the identified first pixel to compensate for the identified first pixel with reference to a search of the predetermined region of pixels;

generating, with the controller a modified multi-bit halftoned value for the identified at least one neighboring pixel to control operation of a neighboring inkjet of the inoperable inkjet to eject an ink drop based on the modified multi-bit halftoned value for the identified at least one neighboring pixel; and storing with the controller the modified multi-bit halftoned value for the identified at least one neighboring pixel in the memory to control operation of the plurality of inkjets to produce a printed image with the plurality of inkjets other than the inoperable inkjet to compensate for the inoperable inkjet.

2. The method of claim 1 further comprising:

operating with the controller the plurality of inkjets other than the inoperable inkjet with reference to the multi-bit halftoned image data including the modified multi-bit halftoned value for the identified at least one neighboring pixel to form a printed pattern of ink drops on an image receiving surface.

3. The method of claim 1, the generation of the modified multi-bit halftoned value for the identified at least one neighboring pixel further comprising:

identifying, with the controller, a composite drop for the identified first pixel including a first drop and a second drop with reference to the multi-bit image data of the identified first pixel;

modifying, with the controller, the modified multi-bit halftoned value for a first neighboring pixel in the plurality of neighboring pixels to include a multi-bit halftoned value corresponding to only the first drop in the composite drop of the identified first pixel; and modifying, with the controller, the modified multi-bit halftoned value for a second neighboring pixel in the plurality of neighboring pixels to include a multi-bit halftoned value corresponding to only the second drop in the composite drop of the identified first pixel.

4. The method of claim 1, the generation of the modified multi-bit halftoned value for the identified at least one neighboring pixel further comprising:

Identifying, with the controller, a first drop size for the identified first pixel with reference to the multi-bit image data of the identified first pixel;

modifying, with the controller, a first neighboring pixel in the plurality of neighboring pixels with a multi-bit halftoned value corresponding to a second drop size, the second drop size being smaller than the first drop size; and modifying, with the controller, a second neighboring pixel in the plurality of neighboring pixels with a multi-bit halftoned value corresponding to the second drop size.

5. A method for printing pixels in an image comprising:

identifying, with a controller, a first pixel in multi-bit halftoned image data stored in a memory, the identified first pixel to be printed by an inoperable inkjet in a plurality of inkjets;

identifying, with the controller, at least one neighboring pixel in a predetermined region of pixels around the identified first pixel, the identified at least one neighboring pixel being identified with reference to a search of the predetermined region and the identified at least one neighboring pixel includes a multi-bit halftoned value corresponding to an ink drop size that is less than a maximum ink drop size in the printer in response to none of the neighboring pixels in the predetermined region of pixels around the identified first pixel being deactivated;

generating with the controller a multi-bit halftoned value for the identified at least one neighboring pixel to control operation of a neighboring inkjet of the inoperable inkjet to elect an ink drop based on the multi-bit halftoned value generated for the identified at least one neighboring pixel;

modifying, with the controller, the multi-bit halftoned value generated for the identified at least one neighboring pixel to increase the ink drop size of the identified at least one neighboring pixel to compensate for the identified first pixel of the inoperable inkjet; and storing with the controller the modified multi-bit halftoned value for the identified at least one neighboring pixel in the memory to control operation of the plurality of inkjets to produce a printed image with the plurality of inkjets other than the inoperable inkjet.

6. A method for printing pixels in an image comprising:

identifying, with a controller, a first pixel in multi-bit halftoned image data stored in a memory to be printed by an inoperable inkjet in a plurality of inkjets;

identifying, with the controller, at least one neighboring pixel in a predetermined region of pixels around the identified first pixel to compensate for the identified first pixel with reference to a search of the predetermined region of pixels;

generating, with the controller a modified multi-bit halftoned value for the identified at least one neighboring pixel to control operation of a neighboring inkjet of the inoperable inkjet to elect an ink drop based on the modified multi-bit halftoned value for the identified at least one neighboring pixel;

identifying, with the controller, a second inkjet in the plurality of inkjets positioned to eject an ink drop onto a location for the identified first pixel that corresponds to the inoperable inkjet; and modifying, with the controller, the multi-bit halftoned value of a pixel corresponding to the identified second inkjet in addition to the generation of the modified multi-bit halftoned value for the identified at least one neighboring pixel to enable the second inkjet to eject an ink drop into the location for the identified first pixel; and storing with the controller the modified multi-bit halftoned value for the identified at least one neighboring pixel and the modified multi-bit halftoned value for the pixel corresponding to the identified second inkjet in the memory to control operation of the plurality of inkjets to produce a printed image with the plurality of inkjets other than the inoperable inkjet to compensate for the inoperable inkjet.

7. The method of claim 1, the search of the predetermined region of pixels further comprising:

searching, with the controller, the predetermined region of pixels in a predetermined order until a predetermined maximum number of deactivated pixels in the predetermined region are identified as the at least one neighboring pixel.

8. The method of claim 7 further comprising:

applying, with the controller, a mask corresponding to a portion of the pixels in the predetermined region of pixels prior to the search to omit the portion of the pixels specified by the mask from the search.

9. An inkjet printer comprising:

a plurality of inkjets;

a memory configured with multi-bit halftoned image data for a plurality of pixels;

a controller operatively connected to the plurality of inkjets and the memory, the controller being configured to:

identify a first pixel in the multi-bit halftoned image data stored in the memory to be printed by an inoperable inkjet in the plurality of inkjets;

identify a plurality of neighboring pixels in a predetermined region around the identified first pixel, the pixels in the identified plurality of neighboring pixels having multi-bit halftoned values corresponding to deactivated pixels;

identify at least one neighboring pixel in the predetermined region of pixels around the identified first pixel to compensate for the identified first pixel with reference to a search of the predetermined region of pixels;

generate a modified multi-bit halftoned value for the identified at least one neighboring pixel to control operation of a neighboring inkjet of the inoperable inkjet to eject an ink drop based on the modified multi-bit halftoned value for the identified at least one neighboring pixel; and store the modified multi-bit halftoned value for the identified at least one neighboring pixel in the memory to control operation of the plurality of inkjets to produce a printed image with the plurality of inkjets other than the inoperable inkjet to compensate for the inoperable inkjet.

10. The inkjet printer of claim 9 further comprising:

an image receiving surface; and the controller being further configured to:

operate the plurality of inkjets other than the inoperable inkjet with reference to the multi-bit halftoned image data including the modified multi-bit halftoned value generated for the identified at least one neighboring pixel to form a printed pattern of ink drops on the image receiving surface.

11. The inkjet printer of claim 9, the controller being further configured to:

identify a composite drop corresponding to the identified first pixel including a first drop and a second drop with reference to the multi-bit image data of the identified first pixel stored in the memory;

modify a multi-bit halftoned value for a first neighboring pixel in the plurality of neighboring pixels to include a multi-bit halftoned value corresponding to only the first drop in the composite drop of the identified first pixel; and modify a multi-bit halftoned value for a second neighboring pixel in the plurality of neighboring pixels to include a multi-bit halftoned value corresponding to only the second drop in the composite drop of the identified first pixel.

12. The inkjet printer of claim 9, the controller being further configured to:

identify a first drop size corresponding to the identified first pixel with reference to the multi-bit image data of the identified first pixel;

modify a first neighboring pixel in the plurality of neighboring pixels with a multi-bit halftoned value corresponding to a second drop size, the second drop size being smaller than the first drop size; and modify a second neighboring pixel in the plurality of neighboring pixels with a multi-bit halftoned value corresponding to the second drop size.

13. An inkjet printer comprising:

a plurality of inkjets;

a controller operatively connected to the plurality of inkjets and a memory, the controller being configured to:

identify a first pixel in the multi-bit halftoned image data stored in the memory, the identified first pixel to be printed by an inoperable inkjet in the plurality of inkjets;

identify at least one neighboring pixel in a predetermined region of pixels around the identified first pixel with reference to a search of the predetermined region of pixels, the identified at least one neighboring pixel includes a multi-bit halftoned value corresponding to an ink drop size that is less than a maximum ink drop size in the printer in response to none of the neighboring pixels in the predetermined region of pixels around the identified first pixel being deactivated;

generate a multi-bit halftoned value for the identified at least one neighboring pixel to control operation of a neighboring inkjet of the inoperable inkjet to elect an ink drop based on the modified multi-bit halftoned value for the identified at least one neighboring pixel;

modify the generated multi-bit halftoned value of the identified at least one neighboring pixel to increase the ink drop size corresponding to the multi-bit halftoned value generated for the identified at least one neighboring pixel to compensate for the identified first pixel of the inoperable inkjet;

store the modified multi-bit halftoned value for the identified at least one neighboring pixel in the memory to control operation of the plurality of inkjets to produce a printed image with the plurality of inkjets other than the inoperable inkjet to compensate for the inoperable inkjet.

14. An inkjet printer comprising:

a plurality of inkjets;

a memory configured with multi-bit halftoned image data for a plurality of pixels;

a controller operatively connected to the plurality of inkjets and the memory, the controller being configured to:

identify a first pixel in the multi-bit halftoned image data stored in the memory to be printed by an inoperable inkjet in the plurality of inkjets;

identify at least one neighboring pixel in a predetermined region of pixels around the identified first pixel to compensate for the identified first pixel with reference to a search of the predetermined region of pixels;

generate a modified multi-bit halftoned value for the identified at least one neighboring pixel to control operation of a neighboring inkjet of the inoperable inkjet to elect an ink drop based on the modified multi-bit halftoned value for the identified at least one neighboring pixel;

identify a second inkjet in the plurality of inkjets positioned to eject an ink drop onto a location corresponding to the identified first pixel that corresponds to the inoperable inkjet;

modify the multi-bit halftoned value of a pixel corresponding to the identified second inkjet in addition to the generation of the modified multi-bit halftoned value for the identified at least one neighboring pixel to enable the second inkjet to eject an ink drop into the location corresponding to the identified first pixel; and store the modified multi-bit halftoned value for the identified at least one neighboring pixel and the modified multi-bit halftoned value of the pixel corresponding to the identified second inkjet in the memory to control operation of the plurality of inkjets to produce a printed image with the plurality of inkjets other than the inoperable inkjet to compensate for the inoperable inkjet.

15. The inkjet printer of claim 9, the controller being further configured to:

search the predetermined region of pixels in a predetermined order until a predetermined maximum number of deactivated pixels in the predetermined region are identified as the at least one neighboring pixel.

16. The inkjet printer of claim 15, the controller being further configured to:

apply a mask corresponding to a portion of the pixels in the predetermined region of pixels prior to the search of the predetermined region to omit the portion of the pixels specified by the mask from the search.

17. The inkjet printer of claim 9, the controller further comprising:

a first hardware module configured to:

receive the multi-bit halftoned image data from the memory;

identify the first pixel corresponding to the inoperable inkjet and having a multi-bit halftoned value corresponding to only a first drop size; and generate first modified image data including the modified multi-bit halftoned value for the at least one neighboring pixel of the identified first pixel; and a second hardware module configured to:

receive the first modified image data from the first hardware module;

identify a second pixel in the first modified image data corresponding to the inoperable inkjet and having a multi-bit halftoned value corresponding to only a second drop size;

generate second modified image data including another modified multi-bit halftoned value for at least one other neighboring pixel of the identified second pixel; and store the second modified image data in the memory including modified multi-bit halftoned values for the at least one neighboring pixel of the identified first pixel and the at least one other neighboring pixel of the identified second pixel.

18. An inkjet printer comprising:

a plurality of inkjets configured to eject drops of ink onto an image receiving member;

a first hardware module having a memory configured to:

receive multi-bit halftoned image data;

identify a first pixel corresponding to an inoperable inkjet;

identify a plurality of pixels neighboring the identified first pixel;

search a predetermined region within the identified plurality of pixels neighboring the identified first pixel to identify at least one pixel location that compensates for the identified first pixel; and generate a multi-bit halftoned value for the identified at least one pixel location that compensates for the identified first pixel;

and a second hardware module having a memory configured to:

receive from the first hardware module the multi-bit halftoned image data with the generated multi-bit halftoned value for the identified at least one pixel location that compensates for the identified first pixel;

identify a second pixel in the multi-bit halftoned image data received from the first hardware module that corresponds to the inoperable inkjet;

identify a plurality of pixels neighboring the identified second pixel;

search a predetermined region within the identified plurality of pixels neighboring the identified second pixel to identify at least one pixel location that compensates for the identified second pixel, the search being performed in a predetermined order until a maximum number of deactivated pixels in the predetermined region are identified;

generate a multi-bit halftoned value for the identified at least one pixel location that compensates for the identified second pixel; and store in the memory of the second hardware module the multi-bit halftoned image data with the generated multi-bit halftoned value for the identified at least one pixel location that compensates for the identified second pixel and the generated multi-bit halftoned image data for the identified pixel location that compensates for the identified first pixel in the memory of the second hardware module.

19. The inkjet printer of claim 18, the first hardware module further comprising:

a read direct memory access unit configured to store multi-bit halftoned image data to the memory in the first hardware module.

20. The inkjet printer of claim 19, each of the first hardware module and the second hardware module are further configured with:

a controller configured to:

search for pixels in the predetermined region around the pixel identified as corresponding to an inoperable inkjet to identify pixels to compensate for inoperable inkjets; and control modification of multi-bit halftoned image data to compensate for the inoperable inkjets.

21. The inkjet printer of claim 20, each of the first hardware module and the second hardware module further comprising:

a reconfigurable logic device that is configured with reference to synthesized place and route configuration data stored in the memories of the first hardware module and the second hardware module.

22. The inkjet printer of claim 21 wherein each reconfigurable logic device is a field programmable gate array.

23. The inkjet printer of claim 20, the controller of the first hardware module is further configured to:

control an order of searching the plurality of neighboring pixels.

24. The inkjet printer of claim 23, the controller of the first hardware module is further configured to:

search the pixels in the predetermined region about the identified first pixel until a predetermined maximum number of deactivated pixels are identified.

25. The inkjet printer of claim 20, the controllers of the first hardware module and the second hardware module are further configured to:

search for pixels in the predetermined region that have multi-level halftoned image data corresponding to a size of a drop of ink that is less than a maximum size of a drop of ink that can be ejected by an inkjet in the printer.

26. The inkjet printer of claim 25, the controllers of the first hardware module and the second hardware module are configured to:

store modified multi-bit halftoned image data that increases the size of the drop of ink in a pixel located in the search.

27. The inkjet printer of claim 20, the controller of the first hardware module is configured to:

identify deactivated pixels in the search of the predetermined region of pixels about the identified first pixel.

28. The inkjet printer of claim 20, the controller of the first hardware module is configured to:

search for pixels corresponding to a first ink drop size; and the second hardware module is configured to search for pixels corresponding to a second ink drop size, the first ink drop size and the second ink drop size being different.

29. The inkjet printer of claim 20 wherein the controllers of the first hardware module and the second hardware module are configured to:

search for a number of pixels in the plurality of neighboring pixels with reference to a size of an ink drop corresponding to a pixel for the inoperable inkjet.

30. The inkjet printer of claim 20, the controllers of the first hardware module and the second hardware module being further configured to:

remove pixels from the search of the plurality of neighboring pixels around the pixels corresponding to an inoperable inkjet with masks stored in the memories of the first hardware module and the second hardware module.

31. The inkjet printer of claim 18, the second hardware module further comprising:

a write direct memory access unit configured to store modified multi-bit halftoned image data to a memory that a controller uses to control ink image formation by the printer.

* * * * *